US007867336B2

(12) United States Patent
Zanolli

(10) Patent No.: US 7,867,336 B2
(45) Date of Patent: Jan. 11, 2011

(54) CLEANING WASTEWATER HOLDING TANKS

(76) Inventor: George E. Zanolli, 734 Lower State Rd., North Wales, PA (US) 19454

( * ) Notice: Subject to any disclaimer, the term of this patent is extended or adjusted under 35 U.S.C. 154(b) by 745 days.

(21) Appl. No.: 11/880,746

(22) Filed: Jul. 24, 2007

(65) Prior Publication Data

US 2009/0025756 A1 Jan. 29, 2009

(51) Int. Cl.
*B08B 3/12* (2006.01)

(52) U.S. Cl. ..... 134/1; 134/10; 134/13; 134/18; 134/22.1; 134/32; 134/34; 134/42; 210/104; 210/257.1; 210/744; 210/748.01

(58) Field of Classification Search ..... 210/744, 210/748.01, 104, 257.1; 134/1, 10, 13, 18, 134/22.1, 32, 33, 34, 42
See application file for complete search history.

(56) References Cited

U.S. PATENT DOCUMENTS

| | | | | |
|---|---|---|---|---|
| 3,363,806 A | | 1/1968 | Blakeslee et al. | |
| 3,408,876 A | | 11/1968 | Andrews | |
| 3,535,713 A | | 10/1970 | Helke et al. | |
| 3,536,196 A | * | 10/1970 | Zeff | 210/97 |
| 3,740,028 A | * | 6/1973 | Bodine | 366/114 |
| 4,167,341 A | * | 9/1979 | Doyel | 366/114 |
| 4,944,886 A | * | 7/1990 | Masri | 210/748.03 |
| 5,642,746 A | | 7/1997 | Sayce | |
| 5,749,102 A | | 5/1998 | Duell | |
| 6,039,867 A | * | 3/2000 | Frei et al. | 210/173 |
| 7,156,574 B1 | | 1/2007 | Garst | |
| 2004/0026334 A1 | * | 2/2004 | Soll et al. | 210/748 |
| 2005/0120969 A1 | * | 6/2005 | Billi et al. | 119/166 |

* cited by examiner

*Primary Examiner*—Sharidan Carrillo
(74) *Attorney, Agent, or Firm*—Howson & HOwson LLP

(57) ABSTRACT

Vibrators, each comprising an electric motor having an eccentric weight on its rotating shaft, are adhesively secured to the bottoms of the wastewater holding tanks of a recreational vehicle, to aid in flushing the tanks by dislodging solid debris from the inside walls and bottoms of the tanks and from the electrodes of the liquid level sensors in the tanks.

6 Claims, 2 Drawing Sheets

CLEANING WASTEWATER HOLDING TANKS

FIELD OF THE INVENTION

This invention relates to wastewater holding tanks of the kind used in recreational vehicles, and more particularly to an apparatus for assisting in the flushing of solid debris from such tanks and for preventing solid debris from interfering with the operation of liquid level sensors in such tanks.

BACKGROUND OF THE INVENTION

A recreational vehicle, also known by the abbreviation RV, is typically equipped with two wastewater holding tanks. One is referred to as a "dark water" tank, and is used for holding waste from the vehicle's toilet. The other tank, referred to as a "grey water" tank, is used for holding all other wastewater, e.g. drainage from sinks, a shower, etc.

These tanks are usually equipped with liquid level sensors that provide an indication of how much liquid has accumulated in them, so that the vehicle operator can drain the tanks into disposal facilities provided at a campsite, e.g., sewers, sewage treatment plants, or septic systems.

Solid matter tends to accumulate in these tanks over time, and periodic cleaning of the tanks is required.

One typical method of cleaning is to close off the inlet and outlet of a tank, partially fill it with water from a water supply to pressurize air above the water in the tank, and then open the outlet so that the air pressure produces a rapid, turbulent flow of water through the outlet. By repeating this procedure, some solid matter can be released. Improved cleaning can be achieved by providing a spray nozzle inside the tank, which directs a jet of water against the walls of the tank in order to dislodge solid matter.

Examples of these prior methods are described in U.S. Pat. Nos. 7,156,574 and 5,642,746.

One of the problems encountered in cleaning RV wastewater holding tanks is that, in most cases, the liquid level in the tank is determined by sensors positioned at different levels in the holding tank. As the liquid level in the tank rises, the liquid progressively comes into contact with more of the sensors, enabling the liquid level to be displayed by an array of light bulbs or LEDs, each operated by an electrical current in a different one of the sensors.

When wet solid matter accumulates on a sensor, the sensor can give a false indication. Thus, the indicated liquid level in a holding tank can be higher than the actual liquid level, requiring excessive and unnecessary flushing of the tanks. Dislodging solid matter from the liquid level sensors is not easily accomplished using conventional methods. Moreover, it is not easy to determine whether or not a given sensor has been cleared of adhering solid debris.

BRIEF SUMMARY OF THE INVENTION

This invention provides an improved system for cleaning wastewater holding tanks, in which solid matter accumulating on the walls of a holding tank is more rapidly and more effectively dislodged, and in which false liquid level indications due to adhesion of solid debris to the tank's liquid level sensors are reliably prevented.

The wastewater holding system according to the invention comprising a holding tank having an interior surface, an inlet and an outlet, and a vibrator connected to the tank, the vibrator being operable during the process of discharging water from the tank to effect vibration of the tank to dislodge solid debris from the interior surface of the tank.

Preferably, the vibrator is secured to the tank by an adhesive, and comprises an electric motor having a rotating shaft and an eccentric weight on said shaft. In a preferred embodiment, the electric motor is mounted on a base, and the base is secured to the bottom of the tank by an adhesive.

When the tank is equipped with a plurality of sensors for providing an electrical indication of the level of wastewater in the tank, the vibrator ensures that solid debris is reliably dislodged from the sensors so that false liquid level indications are avoided.

In the case of a typical RV, having two wastewater holding tanks, each tank is equipped with a vibrator.

In accordance with the invention, flushing of a wastewater holding tank is carried out by opening the outlet of the tank to discharge wastewater and vibrating the tank to dislodge solid material from said interior surface and from any liquid level sensors in the tank. I prefer to operate the vibrator for a short time before opening the drain valve, and then continue to operate the vibrator during draining until substantially all the wastewater has been discharged from the tank.

Other objects, details and advantages of the invention will be apparent from the following detailed description when read in conjunction with the drawings.

DETAILED DESCRIPTION OF THE PREFERRED EMBODIMENT

Figure 1:
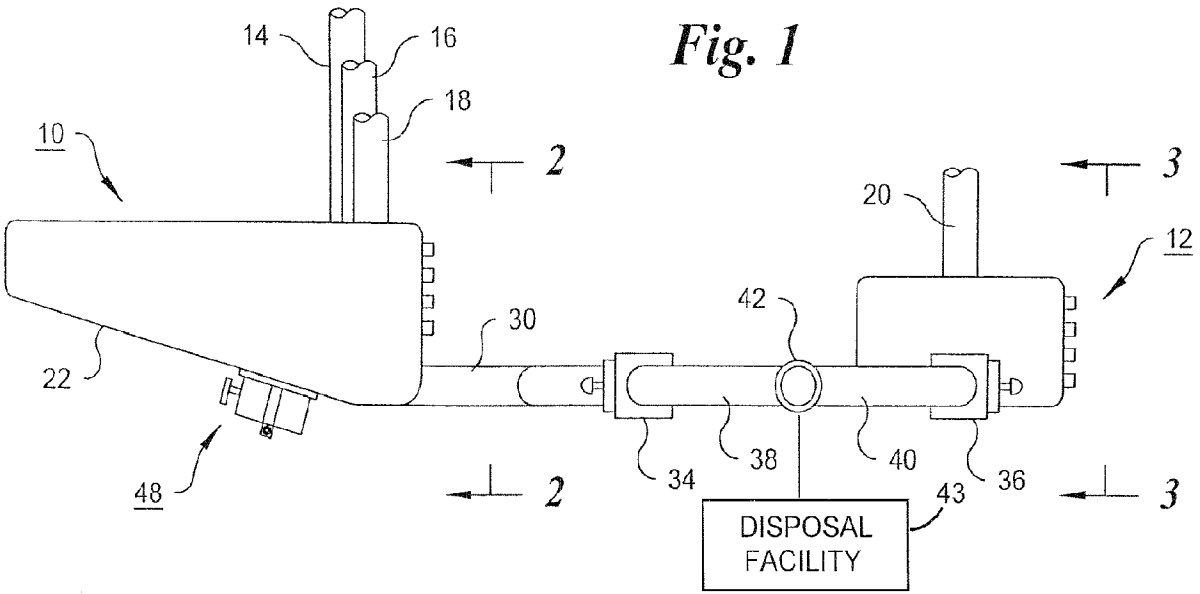
FIG. 1 is a side elevational view of a wastewater holding system for a recreational vehicle, the system comprising two tanks, each equipped with a vibrator, according to the invention.

As shown in FIG. 1, a typical wastewater holding system in a recreational vehicle comprises two tanks: a "grey water" holding tank 10, and a "dark" water holding tank 12. The grey water tank is usually somewhat larger than the dark water tank, and typically has plural inlet pipes, e.g., pipes 14, 16 and 18, leading from various sources such as sinks, showers, etc. The dark water tank typically has only a single inlet, e.g. pipe 20, leading from a toilet, and a vent pipe (not shown).

Figure 3:
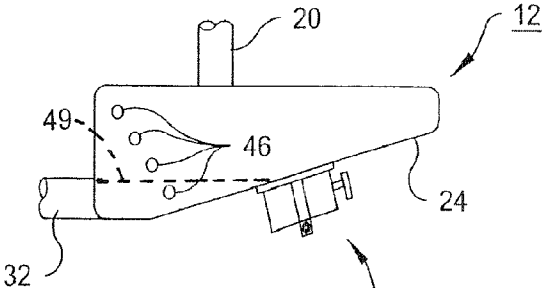
FIG. 3 is a front elevational view of the dark water holding tank of FIG. 1, as viewed through plane 3-3 in FIG. 1.
Figure 4:
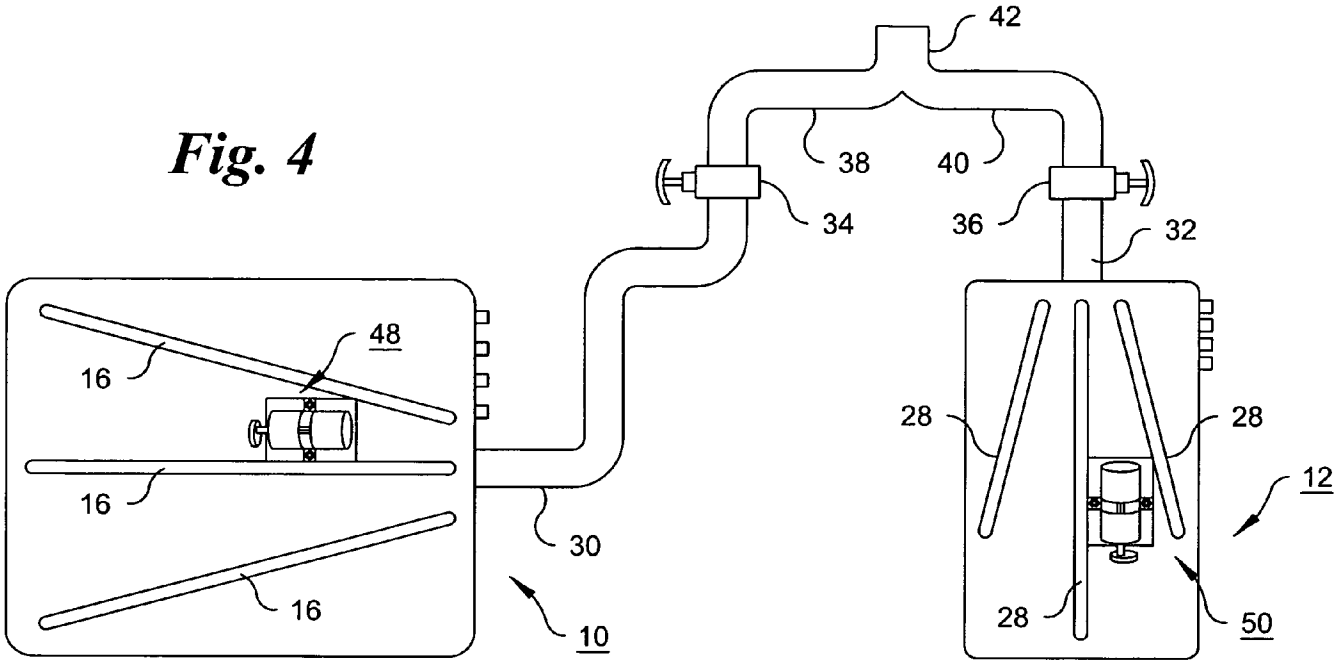
FIG. 4 is a bottom plan view of the wastewater holding system of FIG. 1.

The tanks are typically made from acrylonitrile-budadiene-styrene (ABS) resin, and are mounted underneath the floor of the vehicle. As seen in FIG. 1, tank 10 has a sloping bottom 22, and tank 20 has a similar sloping bottom 24, as shown in FIG. 3. The sloping bottoms are typically formed with reinforcing ribs 26 and 28 as seen in FIG. 4. Ribs 26 converge toward outlet pipe 30 adjacent the lowest point in tank 10, and ribs 28 converge toward outlet pipe 32 adjacent the lowest point in tank 12.

As shown in FIGS. 1 and 4, the outlet pipes 30 and 32 are provided respectively with slide valves 34 and 36, which can be opened to drain the tanks. The outlet sides of valves 34 and 36 are connected through pipes 38 and 40 to a common outlet 42, to which a flexible hose (not shown) can be connected for delivery of wastewater to a disposal facility 43 separate from the vehicle, such as a campsite sewer or septic system.

Figure 2:
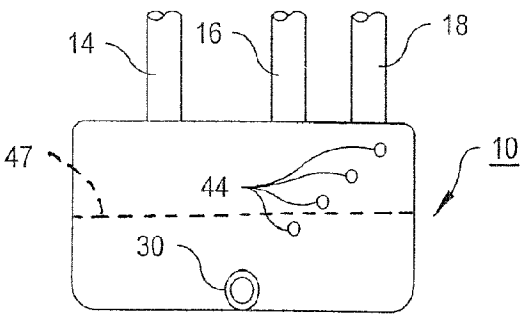
FIG. 2 is a front elevational view of the grey water holding tank of FIG. 1, as viewed through plane 2-2 in FIG. 1.

As shown in FIGS. 2 and 3, the holding tanks are equipped with plural sensors, tank 10 having four sensors 44 at four different levels, and tank 12 similarly having four sensors 46 at four different levels. The sensors extend through the walls of the tanks, and are sealed with water-tight washers and/or caulking. Each sensor includes an electrode which is exposed inside the tank so that it can be submerged in the liquid in the tank. The liquid provides a low-resistance current path from one electrode to another, enabling the set of sensors to provide an indication of the liquid level 47 (FIG. 2) or 49 (FIG. 3) in the tank. The sensors are connected to a source of electrical current, and associated with light emitting diodes (LEDs) or small incandescent bulbs to provide a display indicating the approximate liquid level in each of the tanks. Typically the lowermost three sensors are connected to activate green bulbs, and the uppermost sensor is connected to activate a red bulb, the latter indicating that the tank with which it is associated is nearly full and needs to be drained.

The grey water holding tank 10 is provided with a vibrator 48, as shown in FIGs. and 4, and the dark water holding tank 12 is provided with a similar vibrator 50, as shown in FIGS. 3 and 4. The vibrators are connected to the outsides of the bottoms of the tanks, and situated between reinforcing ribs on flat parts of the bottoms of the tanks.

Figure 5:
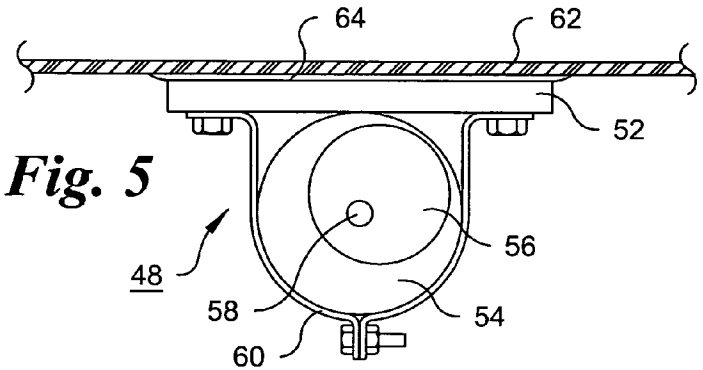
FIG. 5 is an elevational view of the vibrator, showing how the base of the vibrator is adhesively secured to the bottom wall of a holding tank.

In the embodiment shown, the vibrators 48 and 50 are identical, and vibrator 48 is shown in FIG. 5. The vibrator comprises a base 52, and a motor 54 having an eccentric weight 56 mounted on its shaft 58. The motor is secured to the base by a metal strap 60.

The base is preferably a block of ABS resin, and should have a flat surface that can be adhesively secured to a flat portion of the bottom of a holding tank. In FIG. 1, the base 52 is shown cemented to the bottom 62 of a holding tank by a layer 64 of adhesive. By using an adhesive to secure the base to the tank, it becomes unnecessary to drill holes in the tank and the risk of leakage can be avoided. A preferred form of adhesive is the methyltrimethoxysilane/hexamethyldisilazane adhesive known as SILICONE II 100% silicone sealant, available form GE Sealants and Adhesives of Huntersville, N.C. A polydimethylsiloxane adhesive, known as SILICONE I silicone rubber sealant, also available from GE Sealants and Adhesives can also be used.

In applying the adhesive, the portion of the bottom surface of the tank to which the base is to be secured, and the base itself should be thoroughly cleaned. If solvent is used for cleaning or is otherwise present, it should be thoroughly removed, e.g., by washing with water, and the surfaces should be dried. When the SILICONE II and SILICONE I adhesives are used, with properly prepared surfaces, the base of the vibrator can be reliably secured to the holding tank and will withstand most conditions normally encountered in RV usage.

A preferred motor is a 0.05 horsepower, 12 volt, DC motor having a ⅛ inch diameter shaft, and a nominal shaft rotation speed of 1700 rpm. Such low power electric motors are commonly available for use in various applications, such as operating RV exhaust fans. The eccentric weight is a circular brass cylinder having a diameter of ⅞ inch and a thickness of 3/16 inch. A ⅛ inch diameter hole in the weight, for engagement with the shaft has its center offset by ⅛ inch from the geometric center of the weight, and a threaded radial hole (not shown) is provided in the weight for a set screw used to secure the weight to the motor shaft.

The vibrators can be permanently wired, to the RV's battery or to another suitable power source, through a toggle switch that can be positioned at a convenient location adjacent the gate valves.

Figure 6:
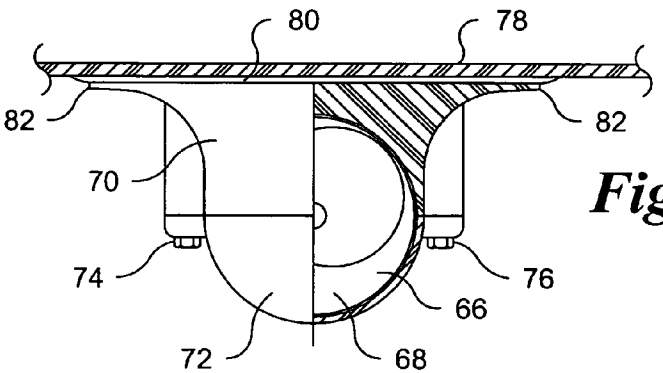
FIG. 6 is an elevational view, partly in section, showing an alternative vibrator mounting.

In the alternative embodiment shown in FIG. 6, the motor 66 and eccentric weight 68, which can be identical to the motor 54 and weight 56 in FIG. 5, are mounted in a sealed housing. The housing is composed of two molded parts: a base 70 and a cap 72. The base and cap are formed with semi-cylindrical mating recesses, which form a cylindrical chamber fitting the motor and having a space for rotation of the eccentric weight on the motor shaft. The cap is secured to the base by a set of four bolts, two of which are seen in FIG. 6 at 74 and 76, to clamp the motor firmly in place. The base is secured to the bottom 78 of a holding tank by a layer 80 of silicone adhesive, and has a tapered edge 82 extending around the base that affords the base a degree of flexibility and thereby eliminates localized stress that could loosen the adhesive bond over time.

In the embodiment shown in FIG. 6, the motor is sealed so that it is not exposed to dirt and moisture. There is no need to provide ventilation for the motor, since the load on the motor is only friction and acceleration of the eccentric weight.

In the operation of the apparatus, the vibrator for each tank is preferably run for about thirty seconds prior to the opening of the valve associated with that tank, and vibration is continued as liquid is discharged, preferably until substantially all the liquid is discharged from the tank. The tanks can be vibrated and flushed either individually or simultaneously. Preferably, however, the dark water tank is flushed first, followed by the grey water tank so that solid debris from the dark water tank is thoroughly flushed from the discharge hose leading from the outlet 42 to the sewer or septic system.

With the use of the vibrators, it has been found that reliable liquid level readings can be obtained consistently, and that solid debris is dislodged from the walls of the tanks and from the level sensors so thoroughly that rinsing by introduction of additional water is unnecessary.

The utility of the system is not limited to recreational vehicles, and the system can be used in buses, trucks and other land vehicles, and also in boats.

Various modifications can be made to the apparatus described. For example, the eccentric weight on the vibrator can be a disc coaxial with the motor shaft and having one or more drilled holes so that its center of gravity is offset from the motor axis. Other forms of vibrators, such as electromagnets with movable armatures and armature-operated current interrupters, can also be used. The vibrators while preferably secured to the tanks by a silicone adhesive, can be secured by other adhesives, or suitable fasteners. In new equipment, the vibrators can be supplied as an integral part of the wastewater holding tanks. Other forms of liquid level sensors can also be used, such as sensors having plural electrodes, or float-operated switches.

Although, in an RV, both the dark water tank and the grey water tank are preferably equipped with vibrators, the problems caused by accumulation of solid matter are more acute in the case of a dark water tank. Thus, in some cases, only the dark water tank will be equipped with a vibrator.

Still other modifications may be made to the apparatus and method described above without departing from the scope of the invention as defined in the following claims.

I claim:

1. A method of flushing a wastewater holding system in a vehicle, the holding system comprising a holding tank having an interior surface and an exterior surface, an inlet, and an outlet, the method comprising the steps of: opening the outlet to discharge wastewater from the holding tank to a disposal facility separate from the vehicle, and, while discharging wastewater from the holding tank, operating a vibrator mounted on the exterior surface of said holding tank to vibrate the holding tank and dislodge solid material from said interior surface and discharge said solid material from said holding tank to said disposal facility.

2. The method according to claim 1, in which said holding tank has a bottom, and in which the step of vibrating the holding tank is carried out by operating the vibrator connected to the bottom of the holding tank.

3. The method according to claim 1, in which the step of vibrating the holding tank is carried out by operating an electric motor connected to the holding tank, the motor having a rotating shaft and an eccentric weight mounted on said shaft.

4. The method according to claim 1, in which wastewater in the holding tank has an upper surface at a level dependent on a quantity of wastewater in the holding tank, and in which the tank is equipped with a plurality of sensors, located at different heights, for providing an electrical indication of the level of wastewater in the tank, and in which the solid material is dislodged from said sensors by vibrating the holding tank.

5. The method according to claim 1 in which said vibrating of the holding tank is commenced before opening of the outlet of the holding tank, and continued during discharge of wastewater from the holding tank to said disposal facility.

6. The method according to claim 1 in which said vibrating of the holding tank is commenced before opening of the outlet of the holding tank, and continued until substantially all the wastewater has been discharged from the holding tank to said disposal facility.

* * * * *